US011613282B2

(12) United States Patent
Aleynikov et al.

(10) Patent No.: US 11,613,282 B2
(45) Date of Patent: Mar. 28, 2023

(54) DOUBLE FRICTION DRAFT GEAR ASSEMBLY

(71) Applicant: Amsted Rail Company, Inc., Chicago, IL (US)

(72) Inventors: Igor Aleynikov, St. Louis, MO (US); Zachary B. Harris, Edwardsville, IL (US)

(73) Assignee: Amsted Rail Company, Inc., Chicago, IL (US)

( * ) Notice: Subject to any disclaimer, the term of this patent is extended or adjusted under 35 U.S.C. 154(b) by 373 days.

(21) Appl. No.: 17/007,317

(22) Filed: Aug. 31, 2020

(65) Prior Publication Data

US 2021/0284205 A1 Sep. 16, 2021

Related U.S. Application Data

(60) Provisional application No. 62/988,435, filed on Mar. 12, 2020.

(51) Int. Cl.
*B61G 9/20* (2006.01)
*B61G 9/06* (2006.01)

(52) U.S. Cl.
CPC ..... *B61G 9/20* (2013.01); *B61G 9/06* (2013.01)

(58) Field of Classification Search
CPC . B61G 9/04; B61G 9/045; B61G 9/06; B61G 9/20; B61G 11/00; B61G 11/02
See application file for complete search history.

(56) References Cited

U.S. PATENT DOCUMENTS

| | | | | |
|---|---|---|---|---|
| 761,795 | A | 6/1904 | Townsend | |
| 1,695,500 | A | 12/1928 | O'Connor | |
| 4,556,149 | A * | 12/1985 | Carlstedt | B61G 9/10 213/34 |
| 4,960,215 | A | 10/1990 | Carlstedt | |
| 5,351,844 | A | 12/1994 | Carlstedt | |
| 6,478,173 | B2 | 12/2002 | Carlstedt | |
| 2008/0290058 | A1 | 11/2008 | Palermo | |
| 2016/0362121 | A1 | 12/2016 | Keener | |

OTHER PUBLICATIONS

International Search Report and Written Opinion for PCT/US2021/015199, dated May 7, 2021.

* cited by examiner

*Primary Examiner* — Robert J McCarry, Jr.
(74) *Attorney, Agent, or Firm* — The Small Patent Law Group LLC; Joseph M. Butscher

(57) ABSTRACT

A dual friction draft gear assembly for a car coupling system of a rail car includes a housing having an internal chamber. One or more friction shoes are disposed within the internal chamber. A first load block has, defines, or otherwise provides a first angled interface with the one or more friction shoes. A second load block has, defines or otherwise provides a second angled interface with the one or more friction shoes.

20 Claims, 4 Drawing Sheets

DOUBLE FRICTION DRAFT GEAR ASSEMBLY

RELATED APPLICATIONS

This application relates to and claims priority benefits from U.S. Provisional Patent Application No. 62/988,435, filed Mar. 12, 2020, which is hereby incorporated by reference in its entirety.

FIELD OF THE DISCLOSURE

Embodiments of the present disclosure generally relate to draft gears for rail vehicles, such as rail cars.

BACKGROUND OF THE DISCLOSURE

Rail vehicles travel along railways, which have tracks that include rails. A rail vehicle includes one or more truck assemblies that support one or more car bodies.

United States Patent No. 761,795 discloses a double spring friction draft rigging. United States Patent Application Publication No. 2016/0362121 discloses a railroad car draft gear. U.S. Pat. No. 6,478,173 discloses a railroad car draft gear having a long travel. United States Patent Application Publication No. 2008/0290058 discloses a railroad car draft gear. U.S. Pat. No. 5,351,844 discloses an elastomeric spring unit.

Draft gears that use Coulomb damping are susceptible to a sliding phenomenon known as "stick and slip," which is believed to be largely due to an inconsistent load path entering friction elements of such gears. As the draft gear is engaged, force is reacted upon a load plate that creates a moment about the friction element because the load plate is perpendicular to a sliding wall. As the draft gear is relaxed, the force is then reacted upon a top angled load block that transfers an offset load directly through the friction element into the sliding wall. This difference between the moment reaction and the offset force creates sticking and slipping, which causes an inconsistent load-displacement curve. Such inconsistency is undesirable for optimal draft gear operation.

Test data taken from a known Coulomb damped draft gear indicates that a load/unload curve is not smooth. This is due to the friction components sticking and slipping which hinders performance of the draft gear.

SUMMARY OF THE DISCLOSURE

A need exists for a draft gear that eliminates, minimizes, or otherwise reduces a potential of sticking and slipping.

With those needs in mind, certain embodiments of the present disclosure provide a dual friction draft gear assembly for a car coupling system of a rail car. The dual friction draft gear assembly includes a housing having an internal chamber. One or more friction shoes are disposed within the internal chamber. A first load block provides a first angled interface with the one or more friction shoes. A second load block provides a second angled interface with the one or more friction shoes. In at least one embodiment, the first angled interface substantially mirrors the second angled interface.

The one or more friction shoes may be disposed between the first load block and the second load block. At least a portion of the first load block and at least a portion of the second block may be within the internal chamber of the housing.

As an example, the one or more friction shoes may include three friction shoes.

A spring stack may be disposed within the internal chamber between a base of the housing and the second load block.

As an example, the first angled interface includes a first angled surface of the one or more friction shoes abutting against a second angled surface of the first load block. Further, the second angled interface includes a third angled surface of the one or more friction shoes abutting against a fourth angled surface of the second load block.

The first load block and the second load block may be coaxial with the housing. The one or more friction shoes may be spaced from a central longitudinal axis of the housing.

Certain embodiments of the present disclosure provide a method of forming a dual friction draft gear assembly for a car coupling system of a rail car. The method includes disposing one or more friction shoes within an internal chamber of a housing; providing a first angled interface between a first load block and the one or more friction shoes; and providing a second angled interface between a second load block and the one or more friction shoes. In at least one embodiment, the method further includes substantially mirroring the first angled interface and the second angled interface.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features.

Moreover, unless explicitly stated to the contrary, embodiments "comprising" or "having" an element or a plurality of elements having a particular condition may include additional elements not having that condition.

Figure 1:
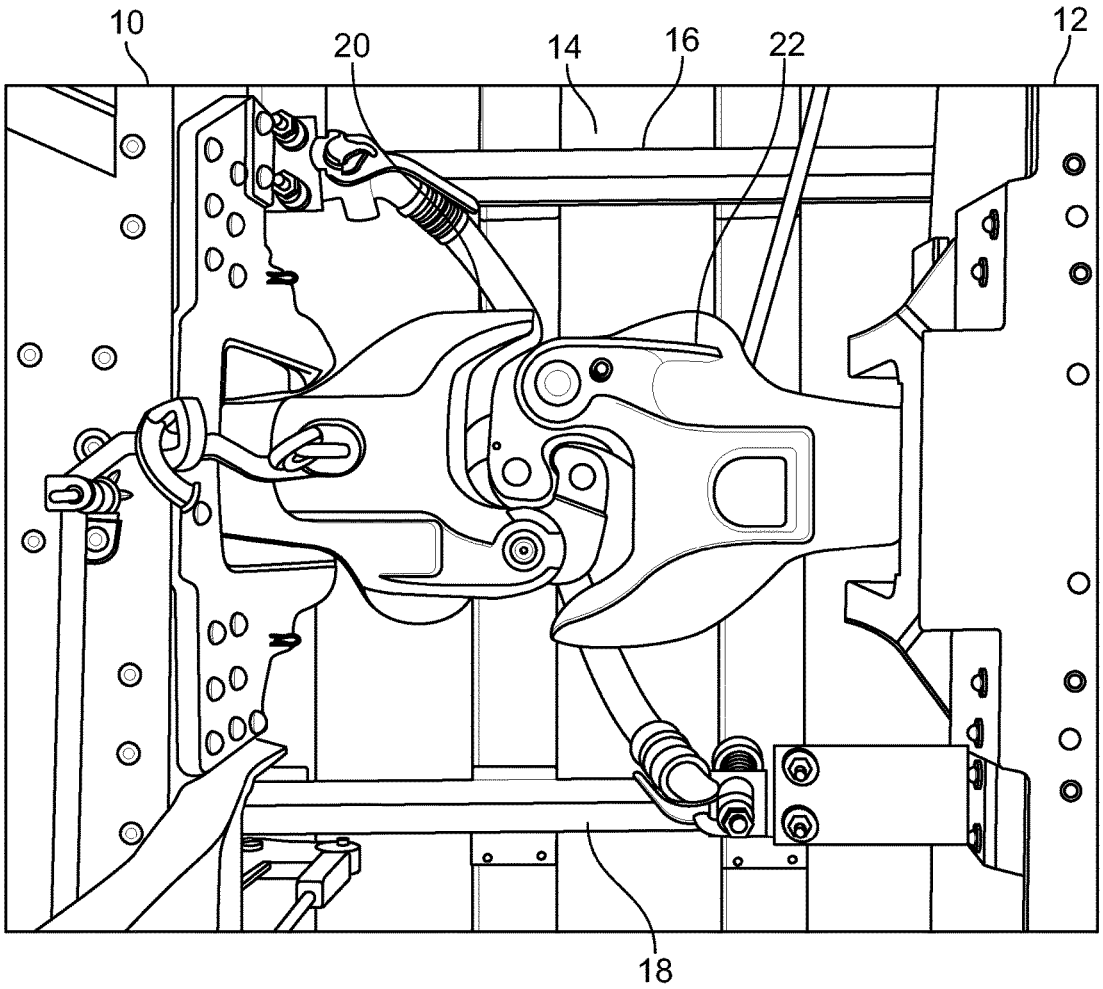
FIG. 1 illustrates a top view of a first rail car coupled to a second rail car.

FIG. 1 illustrates a top view of a first rail car 10 coupled to a second rail car 12. The first rail car 10 and the second rail car 12 are configured to travel along a track 14 having rails 16 and 18. A coupler 20 of the first rail car 10 connects to a coupler 22 of the second rail car 12.

Figure 2:
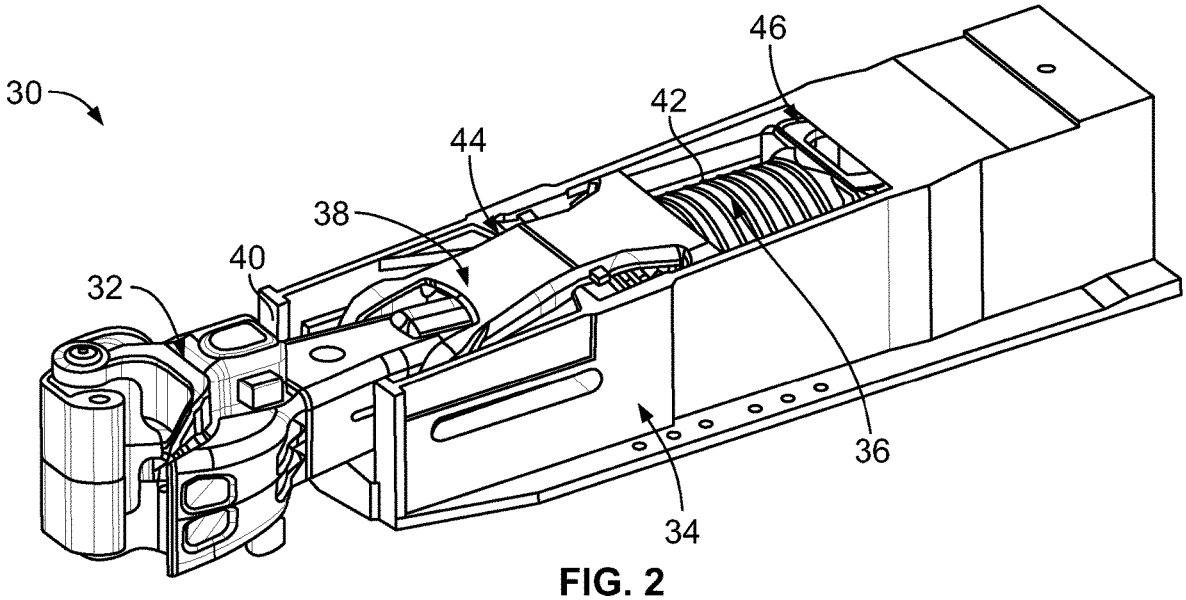
FIG. 2 illustrates a perspective top view of a car coupling system.

FIG. 2 illustrates a perspective top view of a car coupling system 30. The first rail car 10 and the second rail car 12 include a car coupling system 30. The car coupling system 30 includes a coupler 32 (such as the coupler 20 or the coupler 22 shown in FIG. 1), a draft sill 34, and a draft gear 36 with yoke 38. The coupler 32 is supported at a first end 40 by the draft sill 34 and at an opposite second end 42 by the draft gear 36 or cushion unit with the yoke 38. The draft gear 36 or cushion unit is constrained within the draft sill 34 by a pair of front stops 44 and a pair of rear stops 46.

The draft gear 36 may be replaced with the dual friction draft gear assembly 100, according to embodiments of the present disclosure, as shown in FIGS. 3-10 and as described herein.

Figure 3:
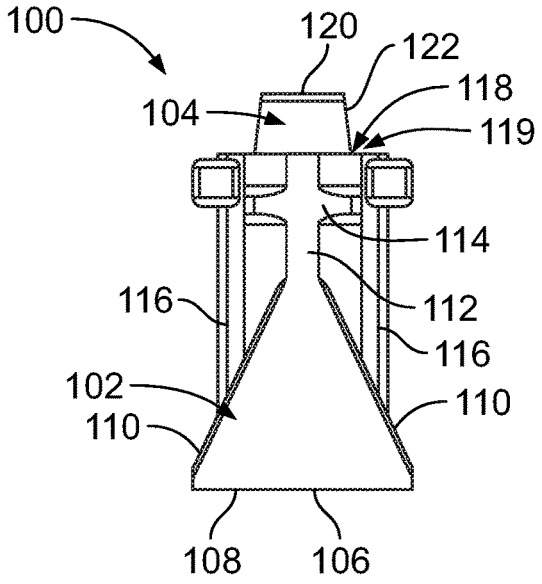
FIG. 3 illustrates a front view of a dual friction draft gear assembly, according to an embodiment of the present disclosure.

FIG. 3 illustrates a front view of a dual friction draft gear assembly 100, according to an embodiment of the present disclosure. The dual friction draft gear assembly 100 includes a housing 102 and a first or top load block, such as friction block 104 (such as a wedge) extending from the housing 102.

The housing 102 includes a base 106 that may include an expanded platform 108. Inwardly-canted support walls 110 may upwardly and inwardly angle from the platform 108 toward one another. The support walls 110 may connect to a linear beam 112 that connects to a cross beam 114.

Walls 116 extend from the platform 108. The walls 116 may be inside the support walls 110, the linear beam 112, and the cross beam 114. The walls 116 are generally orthogonal to the platform 108. An internal chamber 118 is defined between the walls 116 and the base 107. In the orientation shown in FIG. 3, the platform 108 is horizontal, and the interior walls 116 are vertical. It is to be understood that the orientation may be changed so that the platform 108 is vertical, and the interior walls 116 are horizontal. That is, the orientation shown in FIG. 3 is merely an example.

The support walls 110, the linear beam 112, and the cross beam 114 may provide robust bracing support to the housing 102. Alternatively, the housing 102 may not include the support walls 110, the linear beam 112, and the cross beam 114. Instead, the walls 116 may extend upwardly from the base 106 without a support structure around portions of the walls 116.

The friction block 104 extends outwardly from an open end 119 of the internal chamber 118. The friction block 104 may be wedge-shaped. The friction block 104 includes a distal end 120 connected to a head 121 that may outwardly expand from the distal end 120 toward the housing 102.

Figure 4:
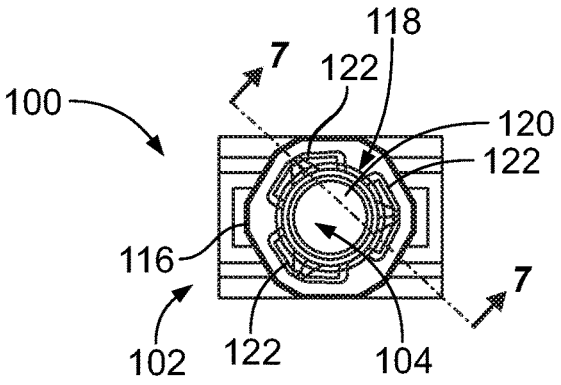
FIG. 4 illustrates a top view of the dual friction draft gear assembly of FIG. 3.

FIG. 4 illustrates a top view of the dual friction draft gear assembly 100 of FIG. 3. As shown, the friction block 104 extends upwardly out of the interior chamber 118. One or more friction shoes 122, such as sliding members having draftless outboard sliding walls, are retained within the interior chamber 118 underneath the friction block 104. As shown, three friction shoes 122 may be regularly spaced within the interior chamber 118 below the friction block 104. Optionally, more or less friction shoes 122 may be used. For example, a single, contiguous friction shoe 122, such as in the form of a friction ring, may be disposed within the interior chamber 118 below the friction block 104.

Figure 5:
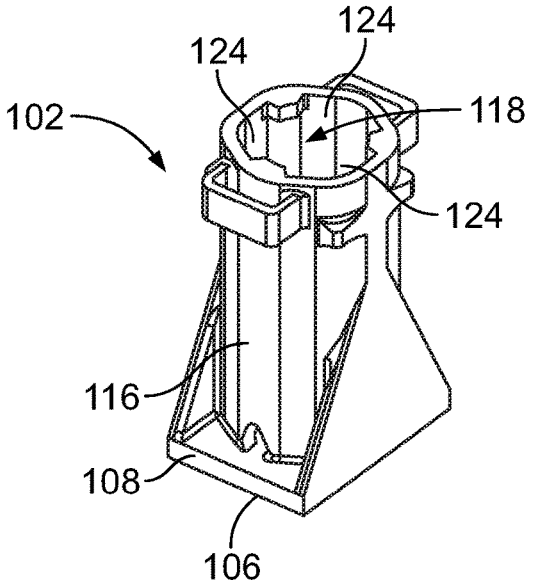
FIG. 5 illustrates a perspective top view of a housing of the dual friction gear assembly of FIG. 3.

FIG. 5 illustrates a perspective top view of the housing 102 of the dual friction gear assembly 100 of FIG. 3. Interior surfaces 124 of the walls 116 may be sized and shaped to slidably retain the friction shoes 122. For example, the interior surfaces 124 may be shaped to conform to an outer surface of the friction shoes 122.

Figure 6:
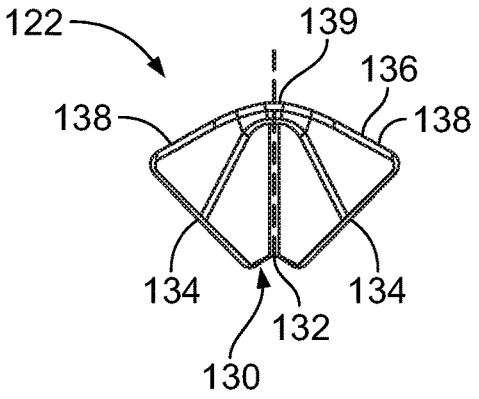
FIG. 6 illustrates a top view of a sliding member of the dual friction gear assembly of FIG. 3.

FIG. 6 illustrates a top view of a friction shoe 122 of the dual friction gear assembly 100 of FIG. 3. The friction shoe 122 includes an inboard wall 130 that may include a notch 132. Lateral walls 134 outwardly angle away from the inboard wall 130. The lateral walls 134 connect to an outboard wall 136 that is opposite from the inboard wall 130. The outboard wall 136 includes lateral wings 138 recessed in relation to a central apex 139. For example, the lateral wings 138 upwardly and arcuately extend from the lateral walls 136 toward the central apex 139. The outboard wall 136 is configured to abut against reciprocal portions of the interior surfaces 124 of the walls 116 (shown in FIG. 5).

Figure 7:
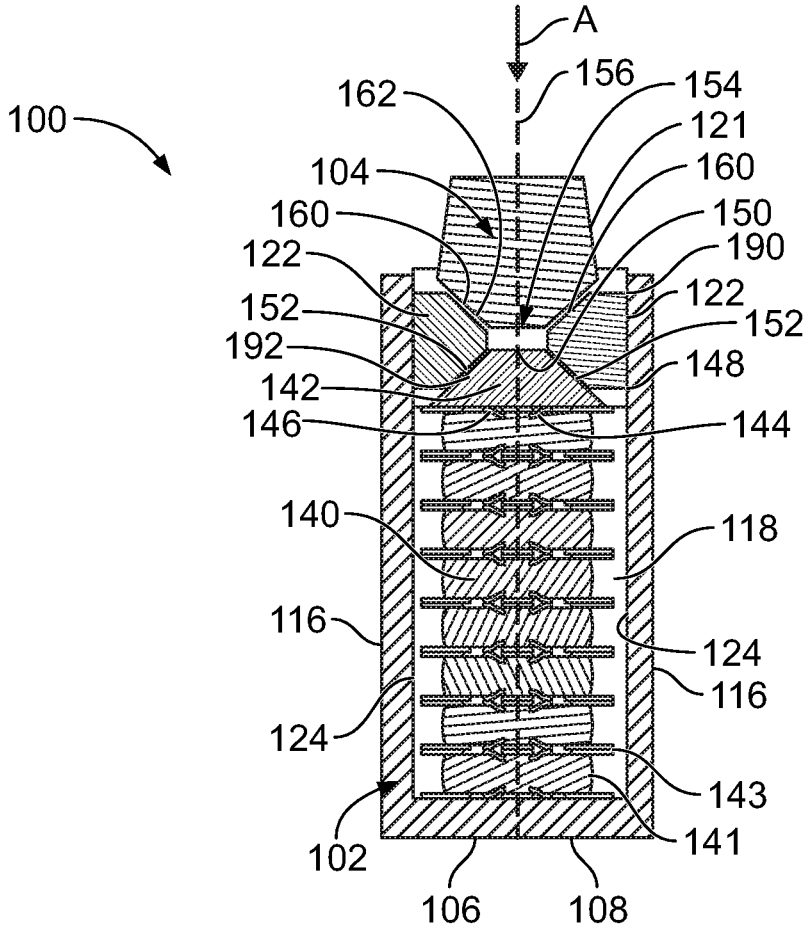
FIG. 7 illustrates a cross-sectional view of the dual friction gear assembly through line 7-7 of FIG. 4.

FIG. 7 illustrates a cross-sectional view of the dual friction gear assembly 100 through line 7-7 of FIG. 4. Referring to FIGS. 3-7, an elastomeric spring stack 140 is retained within the internal chamber 118 between the base 106 a second or bottom load block, such as angled follower 142 (for example, a wedge or block). In at least one embodiment, the spring stack 140 includes a series of elastomeric pads 141 and metal (such as steel) plates 143. The follower 142 and the friction shoes 122 are retained within the internal chamber of the housing 102. The elastomeric pads 141 may be formed from a material and design such that they provide sufficient stiffness and load carrying capabilities along with sufficient hysteresis to aid in the overall damping ability of the dual friction draft gear assembly 100.

The load block or follower 142 includes an expanded end 144 that abuts against an end 146 of the spring stack 140. An angled interface having angled walls or surfaces 148 converge toward a reduced end 150 (opposite from the expanded end 144) that has a smaller diameter or width than the expanded end 144.

The angled walls 148 abut against lower angled surfaces 152 of the friction shoes 122. The reduced end 150 may be disposed within a space 154 between the friction shoes 122. For example, the reduced end 150 may be centered about a central longitudinal axis 156 of the housing 102 directly underneath the friction block 104.

The friction shoes 122 further include upper angled surfaces 160 that abut against a lower angled surface 162 of the load or friction block 104. The lower angled surface 162 of the friction block 104 inwardly and downwardly angle from the head 121 of the friction block 104. The friction block 104 is above the follower 142, with the friction shoes 122 disposed within the internal chamber 118 between the friction block 104 and the follower 142. The friction shoes 122 abut against angled surfaces of the friction block 104 and the follower 142. The friction block 104 and the follower 142 may be centered about the central longitudinal axis 156. For example, the friction block 104 and the follower 142 may be coaxial with the housing 102. The friction shoes 122 may be spaced from and radially about the central longitudinal axis 156.

Accordingly, a first angled interface 190 is disposed (for example, exists) between the friction block 104 and the friction shoe(s) 122. Further, a second angled interface 192 is disposed between the friction shoe(s) 122 and the follower 142.

The dual friction draft gear assembly 100 may have the same fit, form and function as a standard draft gear. For example, the dual friction draft gear assembly 100 may replace the draft gear 36 shown in FIG. 2. The dual friction draft gear assembly 100 may provide a drop-in replacement for existing draft gears. The dual friction draft gear assembly 100 can be used in new car construction as well as service reconditioning.

Due to the design of the current yolks in production, the dual friction draft gear assembly 100 along with production draft gears compress in the same direction regardless of whether a buff load or a draft load is applied. As a buff or draft load is applied through the follower 142, the friction block 104 pushes toward the base 106 of the housing 102 in the direction of arrow A. As the friction block 104 moves toward and/or into the internal chamber 118 in the direction of arrow A, the lower angled surface 162 of the friction block exerts force into the upper angled surfaces 162 of the friction shoes 122. As such, the friction shoes 122 apply an angled load into the friction block 104, and vice versa. The angled load is then transferred into the interior surfaces 124 of the walls 116 of the housing 102.

As the friction block 104 (which is on top, as shown in FIG. 7) is pushed toward the base 106 of the housing 102, the friction block 104 also exerts an angled load into the angled walls 148 of the follower 142. The sum of the angled loads exerted into the follower 142 creates a purely compressive load pushing the follower 142 uniformly toward the base 106 of the housing 102 in the direction of arrow A. As the follower 142 moves toward the base 106 in the direction of arrow A, the follower 142 applies compressive force into the spring stack 140.

The first angled interface 190 mirrors (or at least substantially mirrors within +/−5 degrees, for example) mirrors the second angled interface 192. The angles of the first angled interface 190 and the second angled interface 192 can be between 20-75 degrees, for example.

As described herein, the dual friction draft gear assembly 100 includes a first or top load block (such as the friction block 104) having a first angled interface 190 with one or more friction shoes 122, and a second or bottom load block (such as the follower 142) having a second angled interface 192 with the one or more friction shoes 122. The first angled interface 190 substantially mirrors (such as within +/−5 degrees) the second angled interface 192.

The friction shoes 122 (such as the outboard wall 136) and the interior surfaces 124 of the walls 116 of the housing 102 may be machined to remove any draft. Any draft on such surfaces may create non-uniform loads transferring through the friction shoe 122 into the housing 102. Because of the geometry of the mirrored angled interfaces 190 and 192, offset loads do not create a moment about the outboard walls 136 of the friction shoes 122 that may otherwise induce pitching. The elimination or reduction of the moment eliminates or reduces the risk of stick and slip of the friction shoes 122 in the housing 102. The mirroring of the angled interfaces 190 and 192 may be within a predetermined tolerance, such as within +/−5 degrees.

The elastomeric spring stack 140 provides additional damping capabilities over an ordinary steel coil spring. The combination of the hysteresis of the non-linear elastomeric spring stack 140, the friction damping created as the sliding outboard walls 136 of the friction shoes 104 travel along the interior surfaces 124 of the walls 116, and the elimination or otherwise reduction of stick and slip optimizes a load-displacement curve of the dual friction draft gear assembly 100, and improves performance thereof.

When the buff or draft load is removed from the dual friction draft gear assembly 100, the elastomeric spring stack 140 supplies adequate load to keep an even distribution of contact between the follower 142 and the friction shoes 122. The reactionary load supplied by the follower 142 through the friction block 104 exerts an equal and opposite force on the friction shoes 122. The two equal and opposite forces allow the friction shoes 122 to exert a uniformly distributed sliding friction load within the internal chamber 118 of the housing 102.

In at least one embodiment, a friction modifier or lubricant may be used with the internal chamber 118. Further, dual friction draft gear assembly 100 may also include one or more sliding friction plates.

The shape of the housing 102 may be different than shown. For example, the housing 102 may be round, box-shaped, hexagonal in cross section, or the like. At least portions of the spring stack 140 may be formed of known spring material, such as Arnitel, and/or the like. In at least one other embodiment, the spring stack 140 may be a coil spring.

One or more layers of friction shoes 122 may be used. For example, a single layer of three friction shoes 122 having 45 degree angled surfaces may be used, but additional layers at different angles may be used.

Figure 8:
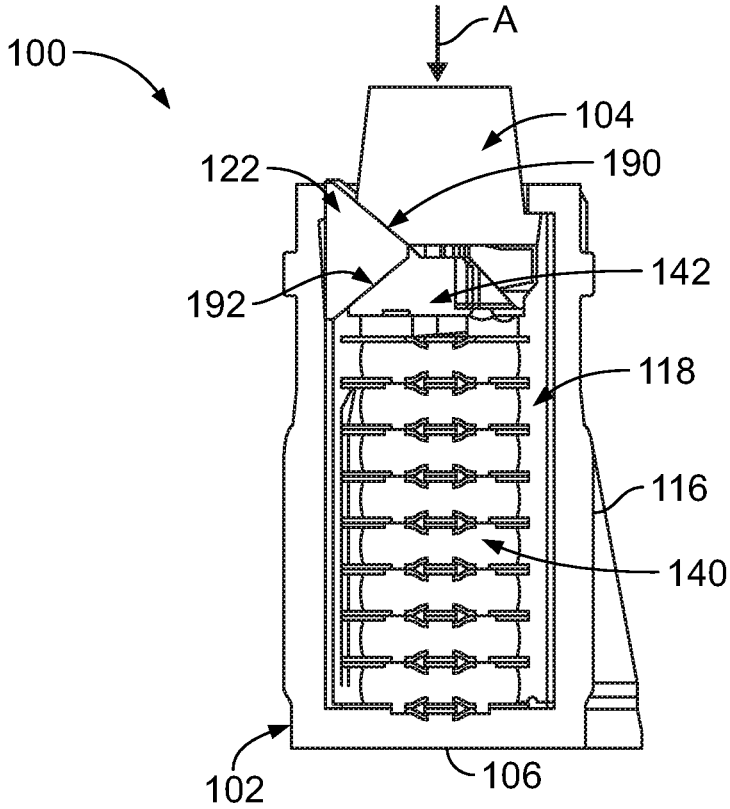
FIG. 8 illustrates an axial cross-section view of a dual friction draft gear assembly similar to FIG. 7, according to an embodiment of the present disclosure.

FIG. 8 illustrates an axial cross-section view of the dual friction draft gear assembly 100 similar to FIG. 7, according to an embodiment of the present disclosure. The friction block 104 may have wedge-shaped portions. The friction block 104 provides a plunger that is configured to move toward the base 106 in the direction of arrow A, thereby exerting force into the friction shoes 122, which, in turn, exerts force into the follower 142, which, in turn exerts a compressive force into the spring stack 140, as described herein. The spring stack 140 may be a co-polyester spring stack.

As shown, a first angled interface 190 is disposed (for example, exists) between the friction block 104 and the friction shoe(s) 122. Further, a second angled interface 192 is disposed between the friction shoe(s) 122 and the follower 142.

Referring to FIGS. 1-8, in at least one embodiment, the dual friction draft gear assembly 100 is for a car coupling system (for example, the car coupling system 30 of FIG. 2) of a rail car (such as the rail car 10 or 12 of FIG. 1). The dual friction draft gear assembly 100 includes the housing 102 having the internal chamber 118. One or more friction shoes 122 are disposed within the internal chamber 118. A first load block (for example, the friction block 104) has a first angled interface 190 with the one or more friction shoes 122. A second load block (for example, the follower 142) has a second angled interface 192 with the one or more friction shoes 122. In at least one embodiment, the first angled interface 1900 substantially mirrors the second angled interface 192 (such as within +/−5 degrees). As shown, the one or more friction shoes 122 are disposed between the first load block and the second load block. At least a portion of the first load block and at least a portion of the second block are within the internal chamber 118 of the housing 102.

Figure 9:
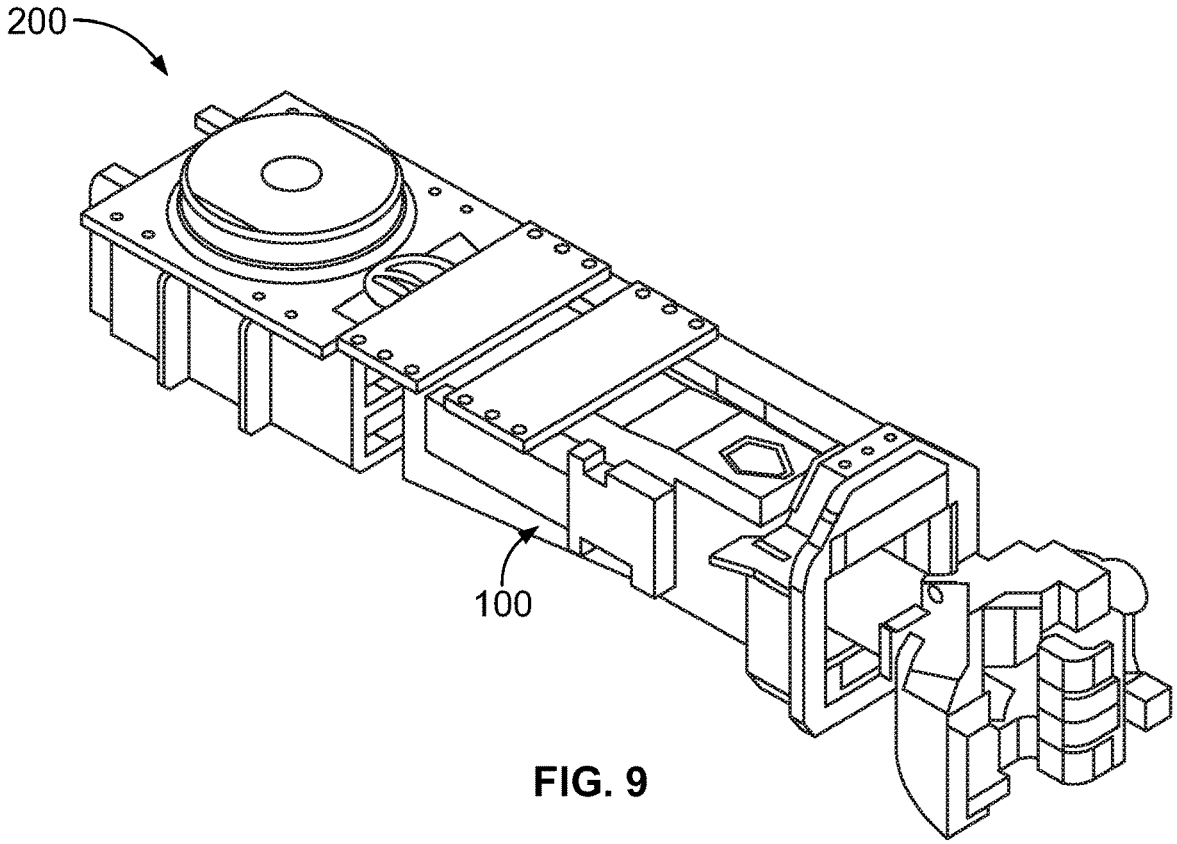
FIG. 9 illustrates a perspective top view of a car coupling system including a draft gear assembly, according to an embodiment of the present disclosure.

FIG. 9 illustrates a perspective top view of a car coupling system 200 including the dual friction draft gear assembly 100, according to an embodiment of the present disclosure. The car coupling system 200 may be manufactured with the dual friction draft gear assembly 100. Optionally, the dual friction draft gear assembly 100 may replace an existing draft gear. For example, a car coupling system 200 may be retrofit with the dual friction draft gear assembly 100.

Figure 10:
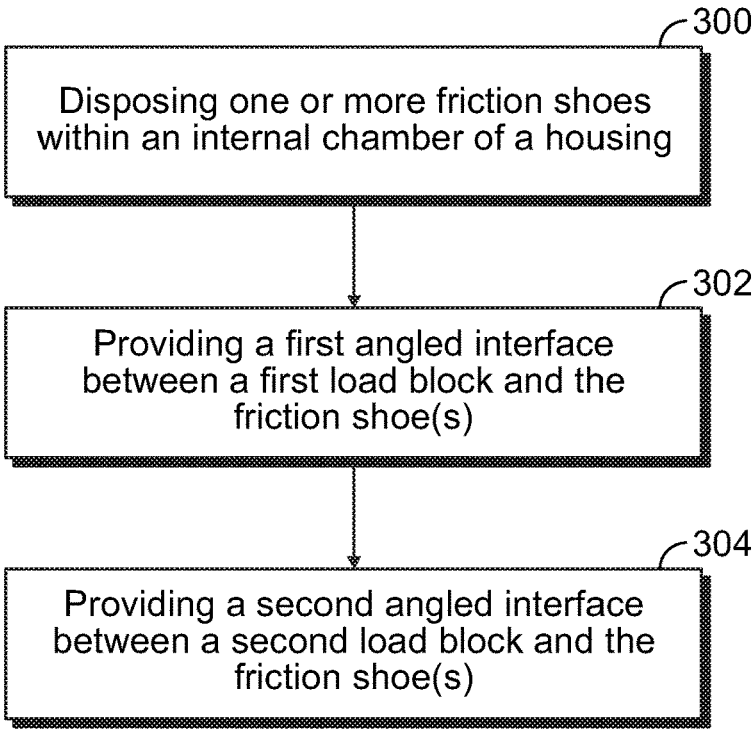
FIG. 10 illustrates a flow chart of a method of forming a dual friction draft gear assembly for a car coupling system of a rail car, according to an embodiment of the present disclosure.

FIG. 10 illustrates a flow chart of a method of forming a dual friction draft gear assembly for a car coupling system of a rail car, according to an embodiment of the present disclosure. The method includes disposing, at 300, one or more friction shoes within an internal chamber of a housing; providing, at 302, a first angled interface between a first load block and the one or more friction shoes; and providing, at 304, a second angled interface between a second load block and the one or more friction shoes. In at least one embodiment, the method further includes substantially mirroring the first angled interface and the second angled interface.

The method may also include disposing the one or more friction shoes between the first load block and the second load block. The method may also include disposing at least a portion of the first load block and at least a portion of the second block within the internal chamber of the housing. The method may also include disposing a spring stack within the internal chamber between a base of the housing and the second load block.

In at least one embodiment, said providing the first angled interface includes abutting a first angled surface of the one or more friction shoes against a second angled surface of the first load block. Said providing the second angled surface includes abutting a third angled surface of the one or more friction shoes against a fourth angled surface of the second load block.

The method may also include coaxially aligning the first load block and the second load block with the housing, and/or radially spacing the one or more friction shoes from a central longitudinal axis of the housing.

As described herein, instead of using a horizontal load plate to react a moment from a friction shoe, the horizontal load plate is replaced with a friction block, friction shoes, and a follower having angled interfaces therebetween. In at least one embodiment, because the angled interfaces may mirror one another, a load vector is symmetric through the loading and unloading of the dual friction draft gear assembly 100. The symmetric loading and elimination of the moment created at a flat load plate both aid in eliminating, minimizing, or otherwise reducing the ability of the friction elements to "stick and slip." Additionally, the double angle (that is, a first angled interface 190 between the friction block 104 and the friction shoe(s) 122, and a second angled interface 192 between the friction shoe(s) 122 and the follower 142, as shown in FIGS. 7 and 8) doubles the normal force from the friction elements allowing for a softer spring to be used for the same impact load.

Accordingly, embodiments of the present disclosure provide a draft gear that eliminates, minimizes, or otherwise reduces "stick and slip." As explained above, "stick and slip" creates an undesirable loading curve that reduces the effectiveness of a draft gear at dampening in-train loads as well as impact loads during humping.

Embodiments of the present disclosure provide a draft gear that offers a symmetric force applied to friction elements for loading and unloading of the draft gear. Because of the mirrored geometry of the top and bottom load blocks (that is, the friction block 104 and the follower 142), the friction elements do not create an undesirable moment about the face of the friction element that would induce wedge pitching, thereby eliminating, minimizing, or otherwise reducing a risk of 'stick and slip' of the friction elements in the draft gear.

The dual friction draft gear assembly 100 as described herein may be used in any field that utilizes Coulomb friction damping in which performance is degraded by "stick and slip." Embodiments can be used in suspension damping as well.

Embodiments of the present disclosure provide dual friction draft gear assemblies 100 that eliminate, minimize, or otherwise reduce a potential of sticking and slipping.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed:

1. A dual friction draft gear assembly for a car coupling system of a rail car, the dual friction draft gear assembly comprising:

a housing having an internal chamber;

one or more friction shoes disposed within the internal chamber;

a first load block providing a first angled interface with the one or more friction shoes;

a second load block providing a second angled interface with the one or more friction shoes; and a spring stack disposed within the internal chamber between a base of the housing and the second load block, wherein the spring stack comprises a series of elastomeric pads and metal plates.

2. The dual friction draft gear assembly of claim 1, wherein the first angled interface substantially mirrors the second angled interface.

3. The dual friction draft gear assembly 1, wherein the one or more friction shoes are disposed between the first load block and the second load block.

4. The dual friction draft gear assembly of claim 1, wherein at least a portion of the first load block and at least a portion of the second load block are within the internal chamber of the housing.

5. The dual friction draft gear assembly of claim 1, wherein the one or more friction shoes comprise three friction shoes.

6. The dual friction draft gear assembly of claim 1, wherein the first angled interface comprises a first angled surface of the one or more friction shoes abutting against a second angled surface of the first load block.

7. The dual friction draft gear assembly of claim 6, wherein the second angled interface comprises a third angled surface of the one or more friction shoes abutting against a fourth angled surface of the second load block.

8. The dual friction draft gear assembly of claim 1, wherein the first load block and the second load block are coaxial with the housing.

9. The dual friction draft gear assembly of claim 1, wherein the one or more friction shoes are spaced from a central longitudinal axis of the housing.

10. The dual friction draft gear assembly of claim 1, wherein the second load block comprises:

an expanded end abutting against the spring stack;

a reduced end opposite from the expanded end, wherein the reduced end is disposed within a space in relation to the one or more friction shoes; and angled walls that converge toward the reduced end, wherein the angled walls abuts against lower angled surfaces of the one or more friction shoes.

11. The dual friction draft gear assembly of claim 10, wherein the one or more friction shoes further comprise upper angled surfaces that abut against a lower angled surface of the first load block.

12. A method of forming a dual friction draft gear assembly for a car coupling system of a rail car, the method comprising:

disposing one or more friction shoes within an internal chamber of a housing;

providing a first angled interface between a first load block and the one or more friction shoes;

providing a second angled interface between a second load block and the one or more friction shoes; and disposing a spring stack within the internal chamber between a base of the housing and the second load block, wherein the spring stack comprises a series of elastomeric pads and metal plates.

13. The method of claim 12, further comprising substantially mirroring the first angled interface and the second angled interface.

14. The method of claim 12, further comprising disposing the one or more friction shoes between the first load block and the second load block.

15. The method of claim 12, further comprising disposing at least a portion of the first load block and at least a portion of the second load block within the internal chamber of the housing.

16. The method of claim 12, wherein said providing the first angled interface comprises abutting a first angled surface of the one or more friction shoes against a second angled surface of the first load block.

17. The method of claim 16, wherein said providing the second angled surface comprises abutting a third angled surface of the one or more friction shoes against a fourth angled surface of the second load block.

18. The method of claim 12, further comprising coaxially aligning the first load block and the second load block with the housing.

19. The method of claim 12, further comprising radially spacing the one or more friction shoes from a central longitudinal axis of the housing.

20. A dual friction draft gear assembly for a car coupling system of a rail car, the dual friction draft gear assembly comprising:

a housing having an internal chamber;

one or more friction shoes disposed within the internal chamber;

a first load block providing a first angled interface with the one or more friction shoes;

a second load block providing a second angled interface with the one or more friction shoes; and a spring stack disposed within the internal chamber between a base of the housing and the second load block, wherein the spring stack comprises a series of elastomeric pads and metal plates, wherein the first angled interface substantially mirrors the second angled interface;

wherein the one or more friction shoes are disposed between the first load block and the second load block;

wherein at least a portion of the first load block and at least a portion of the second load block are within the internal chamber of the housing.

* * * * *